US008215515B2

(12) United States Patent
Churchill

(10) Patent No.: US 8,215,515 B2
(45) Date of Patent: Jul. 10, 2012

(54) INFLATABLE FLOATING BEVERAGE COOLER

(76) Inventor: Robert Lee Churchill, Redlands, CA (US)

( * ) Notice: Subject to any disclaimer, the term of this patent is extended or adjusted under 35 U.S.C. 154(b) by 55 days.

(21) Appl. No.: 12/817,278

(22) Filed: Jun. 17, 2010

(65) Prior Publication Data

US 2010/0252560 A1 Oct. 7, 2010

Related U.S. Application Data

(63) Continuation-in-part of application No. 11/438,810, filed on May 22, 2006, now abandoned.

(51) Int. Cl.
*F25D 3/08* (2006.01)
*B65D 81/24* (2006.01)
*B65D 90/06* (2006.01)

(52) U.S. Cl. ..... 220/560; 220/9.2; 220/592.03; 220/592.2

(58) Field of Classification Search ..... 220/560, 220/592.03, 592.27, 592.2, 9.2, 62.18, 62.13; 441/42; 224/153, 627, 586
See application file for complete search history.

(56) References Cited

U.S. PATENT DOCUMENTS 3,126,933 A 3/1964 Mason et al.
3,397,804 A 8/1968 Davis
4,796,785 A 1/1989 Merritt
4,871,079 A 10/1989 Doucette et al.
4,927,041 A 5/1990 Hepburn
5,474,481 A 12/1995 Ramsey
6,016,933 A 1/2000 Daily et al.
6,085,926 A 7/2000 Weiss
6,269,587 B1 8/2001 Wallace
6,948,632 B2 9/2005 Kellogg et al.
7,195,132 B1 3/2007 Balam
2002/0027141 A1 3/2002 Dokun
2002/0030052 A1 3/2002 Joo-Tai
2002/0113102 A1 8/2002 Klamm
2003/0015528 A1 1/2003 Schneider et al.
2003/0106895 A1 6/2003 Kalal
2005/0103044 A1 5/2005 Mogil et al.

*Primary Examiner* — Mickey Yu
*Assistant Examiner* — Niki Eloshway
(74) *Attorney, Agent, or Firm* — Mind Law Firm; Justin G. Sanders; Jeromye V. Sartain

(57) ABSTRACT

A floating beverage cooler apparatus comprises, in an exemplary embodiment, a flotation bladder configured for removably receiving a beverage container. A protective cover is adapted to enclose and cover the flotation bladder and provides a bottom panel spanning an underside thereof. A storage flap is configured to be at least partially removably engaged substantially centrally with the bottom panel such that, when the apparatus is in use, a cavity is formed between the storage flap and bottom panel for providing added stability and resistance against lateral forces. When the apparatus is not being used, and the flotation bladder is deflated, the storage flap may be rotated about the protective cover and re-engaged with the bottom panel so that the storage flap lies over a top surface of the protective cover, thereby enclosing substantially all of the flotation bladder and protective cover, and optionally the beverage container, in a storage envelope.

19 Claims, 10 Drawing Sheets

INFLATABLE FLOATING BEVERAGE COOLER

RELATED APPLICATIONS

This is a continuation-in-part application of prior filed and currently pending U.S. non-provisional application Ser. No. 11/438,810, filed May 22, 2006, and entitled "Inflatable Cooler Flotation Device with Collapsible Cooler Container." Furthermore, this application claims priority and is entitled to the filing date of the aforementioned application, the contents of which are incorporated by reference herein.

INCORPORATION BY REFERENCE

Applicant hereby incorporates herein by reference any and all U.S. patents and U.S. patent applications cited or referred to in this application.

BACKGROUND OF THE INVENTION

1. Field of the Invention

The present invention relates to insulated containers for beverages and similar products which are collapsible for storage or carrying by a user. The invention further relates to said containers which are fixed in some manner to a flotation device.

2. Description of Related Art

The following art defines the present state of this field:

U.S. Patent Application Publication No. 2002/0027141 to Dokun discloses an anchored, floating drink tray having an annular floating member which maintains a main body above the surface of the water, the main body having a plural number of drinking glass recesses which receive lidded glasses in a secure manner, such that the tray may be temporarily inverted or submerged without harm to the contents in the glasses.

U.S. Patent Application Publication No. 2002/0113102 to Klamm discloses a backpack that is foldable into a compact configuration. The straps on the backpack are made of a lightweight, thin material, allowing the backpack to be rolled into the compact configuration. A compressible storage bag is included in a pouch of the backpack, into which the rolled backpack may be placed. The storage bag may be tethered to the backpack so that it cannot be misplaced. In use, the storage bag is tucked into a pouch so that it does not take internal space in the backpack. When the backpack is emptied, the storage bag is removed from the pouch and the backpack is rolled or compressed into the compact configuration. The compressed backpack is then placed into the storage bag.

U.S. Patent Application Publication No. 2003/0015528 to Schneider et al. discloses a collapsible container including a cylindrical sidewall extending between a top and a bottom of the container. The sidewall is formed of a flexible material which enables the container to be opened to an expanded configuration or closed to a collapsed configuration. A coil spring biases the container to the open configuration. The coil spring has a top coil adjacent the top of the container and a bottom coil adjacent the bottom of the container. A durable bottom layer is affixed to the bottom of the container by at least one clamp.

U.S. Patent Application Publication No. 2003/0106895 to Kalal discloses a collapsible insulative container including a shell having at least one sidewall, a bottom, and a top, where the container is biased toward an operative position wherein the open top is distanced from the bottom to provide an interior defined by the shell. The container further includes a spring that provides the bias urging the container toward the operative position. A liner extends from the shell into the interior defined by the shell to define, in said operative position, a container volume for storing items. In the operative position, air space exists between the shell and the liner. The bias of the spring may be countered to collapse the container from the operative position to a collapsed position to facilitate storage of the container when not in use. Venting means is provided to allow the air to exit and fill the air space when the container is collapsed or moves to the operative position.

U.S. Pat. No. 3,397,804 to Davis discloses a container for transporting toilet articles and the like, the container comprising a substantially cup-shaped member having an open end, a closed end, an outer surface and an inner surface; a base portion connected to the closed end and projecting therefrom, the portion having an upper surface and a lower surface; and an apron having a plurality of pockets affixed thereto, the apron adapted to fit around the outer surface of the cup-shaped member; the cup-shaped member including integral means adjacent an upper portion of the apron for maintaining the apron in position; each of the pockets having a closed end resting on the upper surface of the projecting base portion.

U.S. Pat. No. 4,871,079 to Doucette et al. discloses an integral floating cooler structure including a barge member having a barge bottom and barge sides with a storage chest having a chest bottom formed in common with the barge bottom, and chest sides of less thickness that the barge sides and having lower portions formed in common with the barge sides. The chest bottom and said chest sides are of thickness sufficient to provide thermal insulation. The barge bottom and the barge sides are displacement volume sufficient to provide buoyancy for the cooler structure. The exterior surfaces of the chest sides, the barge sides and the barge bottom forms a common exterior surface for the cooler structure. The interior surface of the chest bottom and the chest sides forms a common interior surface for the cooler structure.

U.S. Pat. No. 4,927,041 to Hepburn discloses a self-stabilizing floating cooler. The cooler includes a pair of upstanding, opposed end panels and elongated side panels extending therebetween to form a contiguous wall. A lid and a bottom panel are provided, and a floor panel is disposed between the lid and the bottom panel to define upper and lower compartments. The upper compartment is thermally insulated, and float members are detachably affixed to the side panels adjacent the floor panel exteriorly thereof. Perforations are provided in the lower compartment for filling the lower compartment with water to buoyantly stabilize the cooler in an upright position when the cooler is placed on water. Perforations also permit draining the water from the lower compartment when the cooler is removed from water.

U.S. Pat. No. 6,016,933 to Daily et al. discloses a floating beverage cooler including a floatable base and a cooler removably coupled to the base. The base has at least one recess formed therein for releasably receiving a beverage therein. The cooler and base further have a coupling mechanism for precluding the separation thereof.

U.S. Pat. No. 6,085,926 to Weiss discloses a cooler chest mounted into a lower container which allows the chest to float without tendency for upending or taking on water. The lower container provides openings for resting items such as drink cans and cups, loose change and keys while one plays in the water. The lower container is of such size and buoyant volume as to support the chest when it is filled with water without allowing the items on the lower container to become wet.

U.S. Pat. No. 7,195,132 to Balam discloses an inflatable container having an inflatable chamber having a main storage compartment and a main storage compartment access opening, and further having a lower portion that includes at least one storage cavity having a storage cavity access opening. The inflatable container also includes an outer cover formed over the exterior of the inflatable chamber. The inflatable container also provides a storage bag that is formed such that when the inflatable chamber is deflated, the inflatable container may be contained within the storage bag.

As illustrated by the above prior art, it has long been known to provide a relatively small, insulated container for storing and carrying beverages cooled by ice for recreational purposes. It has also been well known to provide a flotation device for said insulated containers. Users of these known prior art devices for cold storage and flotation obtain the benefits of an insulated beverage cooler with the ability to have access to it while in a body of water, such as a swimming pool. In addition, beverage cans or cups can be supported in impressions made in the flotation portion of the assembly. However, these known prior art devices have several disadvantages.

One such disadvantage is the fact that these known prior art devices tend to be relatively bulky, even when not being used, making storing these devices somewhat inconvenient. The '132 patent to Balam attempts to solve this problem by disclosing a device having certain inflatable capabilities allowing it to be deflated so that its storage space is less than half of its inflated volume. However, given the overall configuration of the device, inflation and deflation of the entire device tends to be unduly time consuming, resulting in users sometimes electing to simply store the device in its inflated state, both defeating the purpose of having an inflatable cooler as well as leaving open the risk of the device being punctured or damaged during storage. Additionally, the prior art, such as Balam, teaches the incorporation of storage bags for storing the deflated devices, the storage bags being stored themselves in the bottom of the devices. However, a storage bag capable of completely enclosing an item at least twice its size requires duplication of carrying handles, closures and enough material to allow the deflated device to fit. Thus, to store a bag of such size in the bottom of the device during use tends to create an unstable floating surface, which is very disadvantageous.

Another disadvantage with known prior art inflatable coolers is the potential lack of stability when the device is in use (i.e., placed on the surface of a body of water). More specifically, given the known prior art devices' relatively light weight construction, they tend to be more prone to being inadvertently pushed through the water by wind and or currents, thus potentially relocating the devices to less convenient areas of the body of water (i.e., away from the user's reach). Not only does this inconvenience displace the user's beverages, but this has also proven to create a potentially dangerous situation where the user lacks adequate swimming ability to retrieve the wandering cooler.

Thus, there is a need for a device combining quick and compact storage with the benefits of an insulated container borne in a relatively stable flotation device. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention is an inflatable floating beverage cooler comprising, in an exemplary embodiment, a non-inflated insulated beverage container and a flotation device configured for permanently or removably receiving the container. In one embodiment, the container is sized and configured for holding a plurality of beverages, and comprises support means for quickly collapsing the container into a flattened disk or folded down state, as well as connections for a strap with which a user may carry the container by hand or by resting it on a user's shoulder. In another embodiment, the container is a sleeve sized to accept a single beverage.

In a bit more detail with respect to the container embodiment configured to hold a plurality of beverages (i.e., beverage cups, cans, bottles, etc.), a spring embodiment of the container comprises a spiral (round, square or other) metal or polymer expander piece which is structurally connected with flexible sidewalls of the container. The container comprises flexible sidewalls, a floor, and a closeable top, whereby a user is capable of simply pressing the top to the floor so that the container collapses like an accordion. In the collapsed state, the container preferably has a height of about one to three inches but may be more or less. The container in the opened state is expanded to a height of from a few inches to several feet. The expanded height is limited only by stability concerns. In a preferred embodiment, the expander piece is a round spiral steel spring with an internal diameter of one to two feet and an expanded height of one to two feet. In another preferred embodiment, the expansion piece is formed of fiber reinforces polymers with appropriate spring force and memory. In a container with a square horizontal cross section, the expander piece may be a plurality of spring pieces incorporated into sidewalls of the container.

The container may also comprise sidewalls incorporating a layer of elastomer foam or corrugated polymer layers with sufficient rigidity to stand upright when the container holds ice and beverages. The layer of elastomer foam is preferably about 0.3 to 1.5 centimeters in thickness, said foam forming an insulating layer while providing an overall structure that can be quickly folded into a flattened position when it is emptied of ice and beverages.

The flotation device is preferably a round, square, or other inflatable platform having a central impression for receiving and supporting the floor of the container, whereby the container may be floated on the surface of a body of water. In the exemplary embodiment, the flotation device comprises can or cup impressions in the platform surrounding the container impression for receiving and securely holding beverages. In addition, the flotation device may comprise an inflatable bladder encased in a supporting and protective cover of flexible material such as woven nylon fabric.

The invention also comprises storage means for easy carrying and compact storage of the container and flotation device. As described above, a preferred embodiment of the flotation device comprises a flexible sheet material covering substantially all of a flotation bladder. In this storage means embodiment, an underside of said covering bears a second layer of flexible material, the storage flap, secured to said underside by suitable means, such as by a zipper. In a set of steps to accomplish storage, the flotation device is deflated and the container is brought into a collapsed state and located in the container impression in the flotation device. Deflated and flexible portions of the flotation device are folded over the top of the container impression and the container. The storage flap is unzipped along a substantial part of its periphery, disengaging it from said underside of the covering material, and folded along a hinge connection to said underside so that what was an outside surface of the storage flap lies over the folded portions of the flotation device. The zipper of the storage flap is re-zipped to a closed position, thereby enclosing the folded down flotation device and container in a flattened disk, which may be easily stored. When the invention is in use, the positioning and configuration of the storage flap on the underside of the covering of the flotation device allow it to function as a ballast, thereby substantially stabilizing the invention and discouraging the flotation device from being inadvertently pushed by wind and/or currents.

A primary objective inherent in the above described apparatus and method of use is to provide advantages not taught by the prior art.

Another objective is to provide such an apparatus that, in one embodiment, is capable of being quickly and easily moved from an open, erected state to a flattened, storable state by folding or compression and providing means to maintain said container in the flattened state.

Another objective is to provide such an apparatus that comprises means for storage in an enclosure integral with a cover of said apparatus after deflation of an inflatable bladder of the flotation device and bringing the container into a collapsed state, said means for storage also capable of functioning as a ballast when the apparatus is in use.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
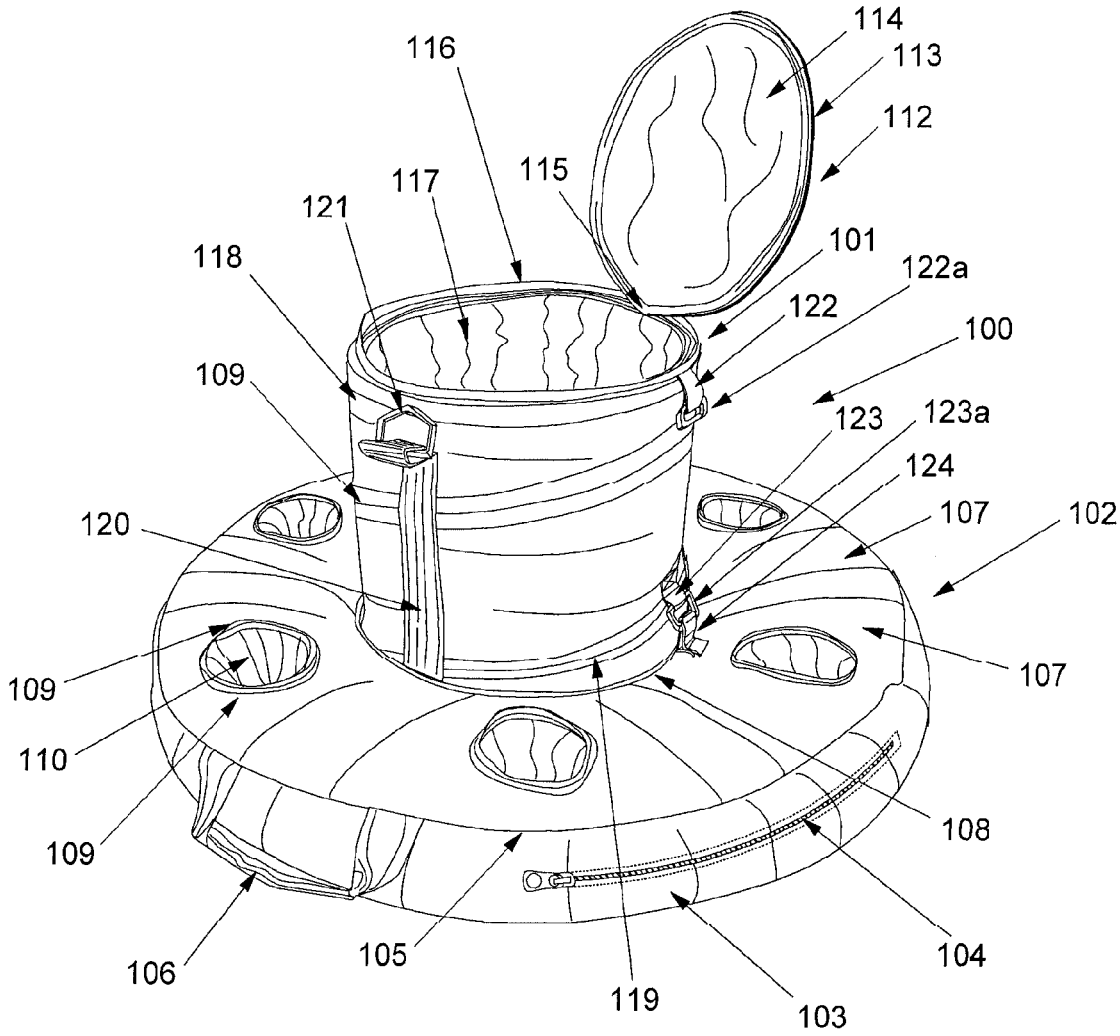
FIG. 1 is a perspective view of an exemplary embodiment of the invention wherein a container is releasably secured to a container impression in the flotation device.

FIG. 1 is a perspective view of the invention assembly 100 comprising a collapsible beverage container 101 and flotation device 102, where said container 101 is, in the exemplary embodiment, releasably secured to a container impression in the flotation device 102. Flotation device 102 generally comprises a flotation bladder (not shown) bound with a protective cover 133, which comprises a outer side panel 103 and a top panel 107 connected by seam 105, which incorporates one of two lifting handles 106. Protective cover 133 is preferably formed from flexible sheet material such as woven nylon fabric or a similar material resistant to abrasion and repeated wetting. Outer side panel 103 comprises a zippered opening 104 for user access to the flotation bladder. Top panel 107 is interrupted by beverage holders 109, which comprise a upwardly open cylinder of flexible material to line beverage container impression 110 and which joins top panel 107 at seam 111. Top panel 107 joins an inner side panel (not shown) at seam 108.

In the exemplary embodiment, container 101 is generally a cylindrical, open topped, insulated, liquid tight container that is secured to the flotation device 102 by two or more hook and loop straps 124 sewn onto top panel 107 and releasably connecting with a rigid link **123*a* secured to cloth loop 123 which is sewn to outer sleeve 118 of container 101. Said connection urges a lower portion of container 101 into a container impression in flotation device 102 so that container 101 cannot be separated from the flotation device 102 without first disengaging the hook and loop straps 124**.

Container 101 further comprises an insulated top cover 112 that has a central part 114 rimmed by a zippered edge 113. Top cover 112 is formed of flexible materials in a manner similar to those of container 101, as described below. Top cover is further preferably connected by sewn connection 115 to a small portion of top zippered edge 116, which is adapted to engage zippered edge 113 of top cover 112 so that container 101 becomes a closed container.

Container 101 further comprises a spiral spring 119 extending from supporting top zippered edge 116 with a circular portion and extending downward in an outwardly visible spiral along the sidewalls of container 101 to another circular portion at a bottom of container 101. Spiral spring 119 provides very strong lateral support and efficient vertical support for the sidewalls of container 101, i.e., for ice, water and beverages which will be stored in the space defined by inner sidewall 117 of container 101. Spiral spring 119 is capable of being compressed in a downward direction, thereby compressing the entire container 101. The sidewalls of container 101 are preferably formed of flexible materials which may be folded in a downward direction upon compression of spiral spring 119. Two straps 120 are sewn to the sidewall of container 101, each terminating in a loop which secures a link 121, which link 121 is adapted to engage a long section of flexible strap material which may be used as a shoulder strap with which to carry container 101 when it is disengaged from flotation device 102.

As shown in FIG. 1, container 101, in the exemplary embodiment, has a lateral diameter of from about one foot to two feet and an open position height of from about one foot to three feet, which can withstand being filled with ice, water, and/or beverages without tipping over or collapsing. Further to this specific embodiment, flotation device 102 has an inflated flotation bladder such that it expands to a horizontal outside diameter of from about 1.5 to 3 feet and a vertical inflated height of from about 3 to 8 inches, or a sufficient inflated volume to prevent top panel 107 from being submerged when a filled container 101 is secured to flotation device 102 and the combination is placed in a body of water, such as a swimming pool. This specific embodiment is not intended to limit the objects of the invention but merely to define preferred embodiments. As shown in FIG. 1, the space defined by inner sidewall 117 of container 101 is capable of being filled with ice, water, and/or beverages, whereafter the entire assembly may be stably floated in a body of water and sustain stable floatation even in the presence of substantial wave action.

Figure 18:
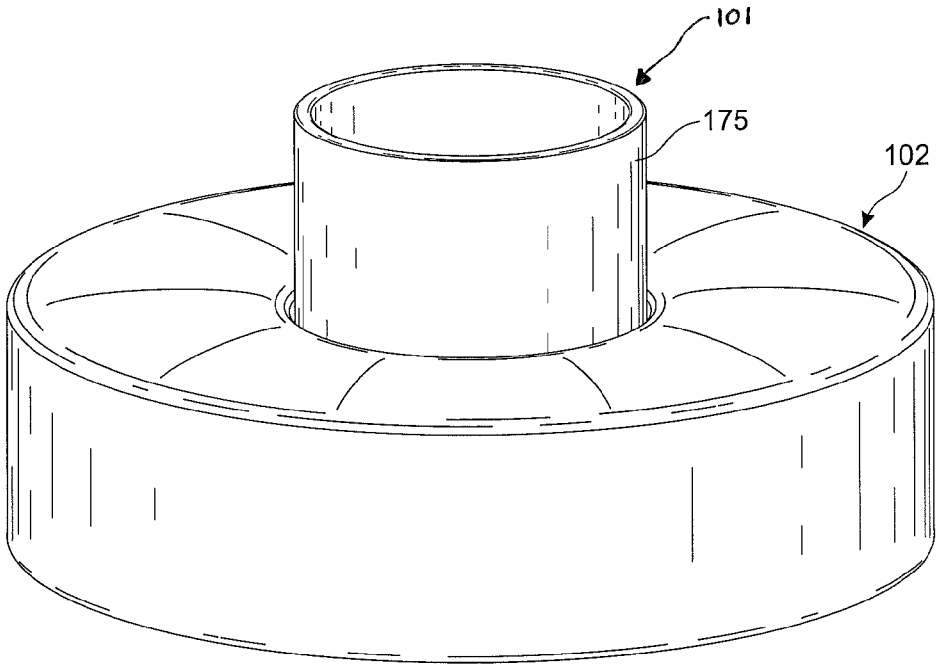
FIG. 18 is a perspective view of a further embodiment of the present invention, wherein the container is sized and configured to accept a single beverage.

In an alternate embodiment, as shown in FIG. 18, container 101 comprises an insulated beverage sleeve 175 sized and configured for accepting a single beverage (not shown). Additionally, in this alternate embodiment, the flotation device 102 and its various elements herein discussed, including the container impression, are proportionately scaled down to accommodate this embodiment.

Turning again to the exemplary embodiment, FIG. 1 also shows rigid link 122*a* secured to cloth loop 122 secured to a top edge of container 101, which form a portion of means for securing container 101 in a closed or compressed position.

Figure 2:
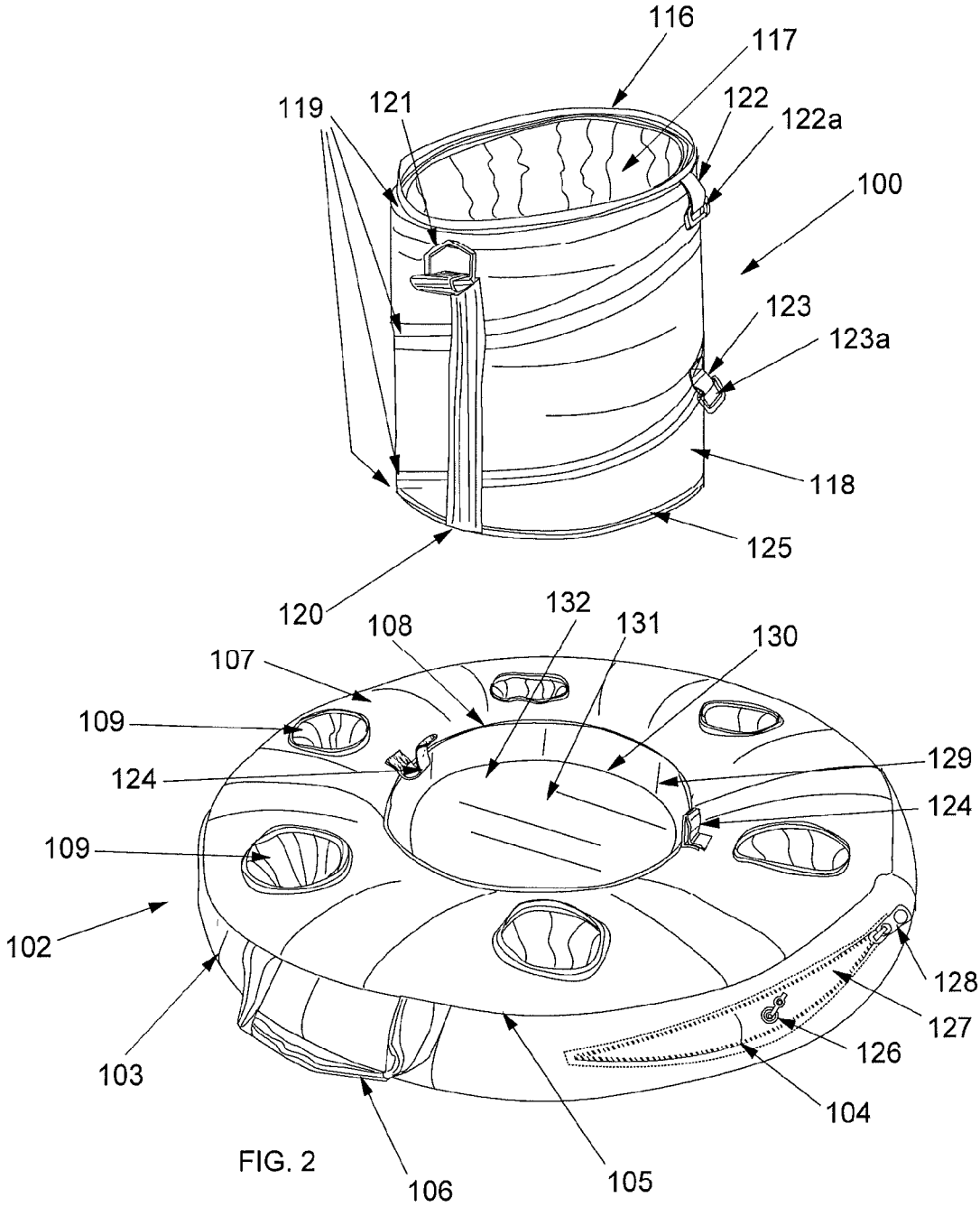
FIG. 2 is a perspective view thereof, with the container removed from the container impression of the flotation device.

FIG. 2 is a perspective view of the container and flotation device of FIG. 1 where the container 101 is released and lifted out of the container impression 132 of the flotation device 102. Top panel 107 is shown connected by seam 108 to inner side panel 129, which in turn connects with floor panel 131 at seam 130. The height of inner side panel 129 is approximately equal to the inflated height of flotation device 102. Zippered opening 104 is opened by moving slider 128 to an opened position, exposing flotation bladder 127 in its inflated state, also showing an opened inflation/deflation stem 126 with closure cap (a well known means for inflating and deflating air mattresses) through which a user may inflate or deflate flotation bladder 127. Thus, a user may simply open zippered opening 104 for access to stem 126 to inflate or deflate flotation device 102.

FIG. 2 shows two hook and loop straps 124, each of which are adapted to engage rigid link 123*a* secured to cloth loop 123, thereby securing container 101 into container impression 132 (as shown in FIG. 1). Container 101 is shown to have a bottom rim 125 supported by a circular portion of spiral spring 119 as described above. The connection of spiral spring 119 to the sidewalls of container 101 prevent them from collapsing inward or outward when container 101 is in its elevated state. Container 101, as shown in FIG. 2, may be used and carried separately from flotation device 102.

Figure 3:
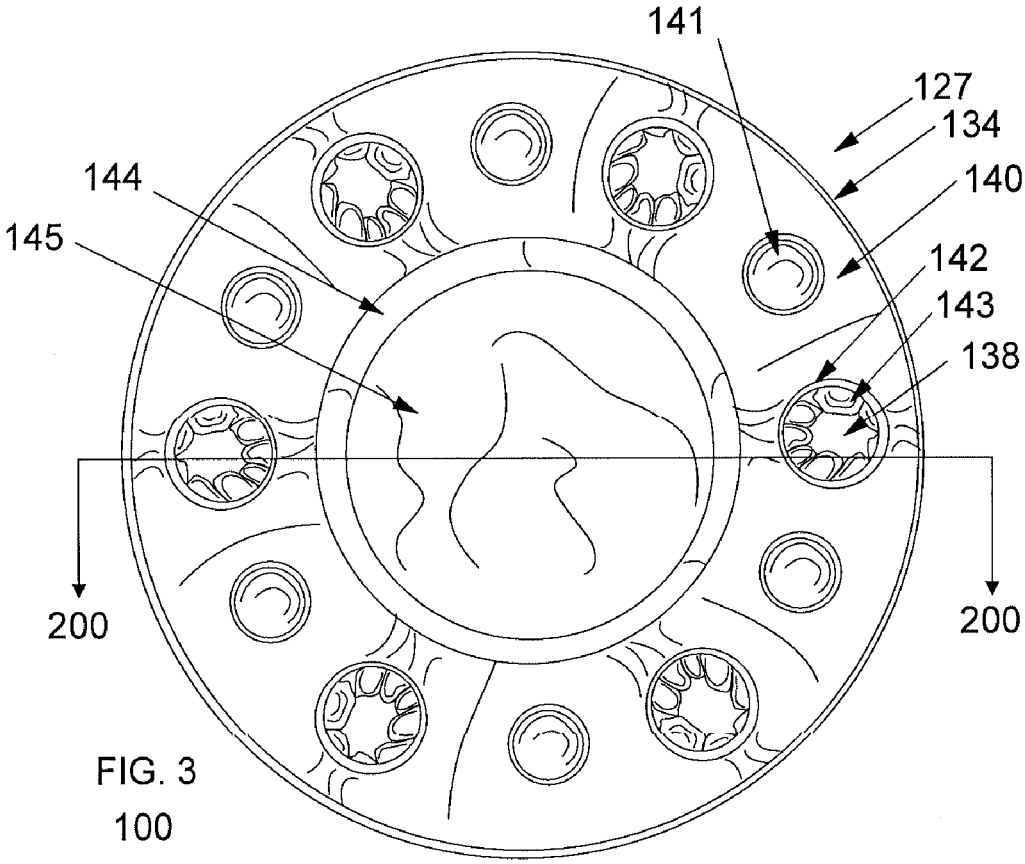
FIG. 3 is a top view of an exemplary embodiment of the flotation bladder without a protective covering.
Figure 4:
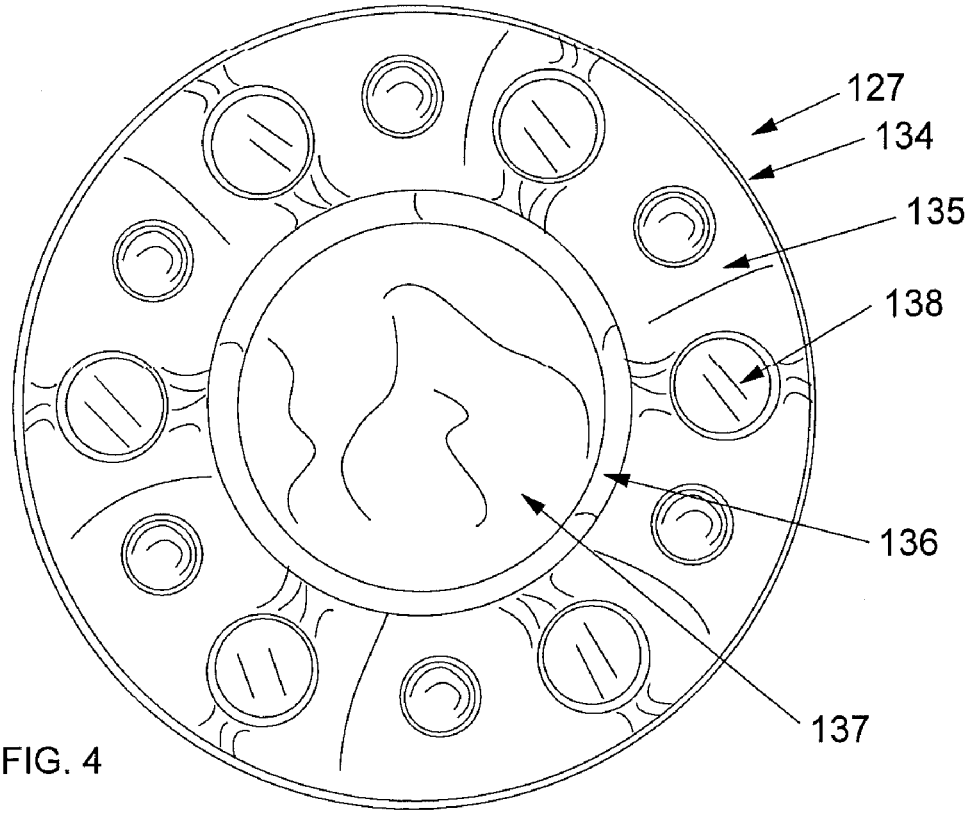
FIG. 4 is a bottom view thereof.
Figure 5:
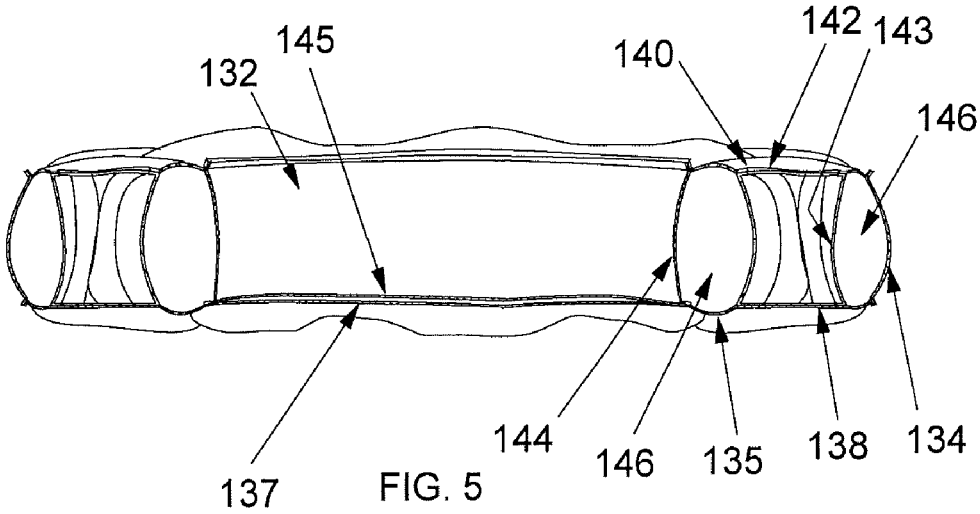
FIG. 5 is a cross-sectional view taken along line 200-200 of FIG. 3.

FIGS. 3, 4 and 5 are respectively top, bottom and section 200 (FIG. 3) views of a flotation bladder 127 of the flotation device 102 shown in FIG. 2 without the protective covering 133. Flotation bladder 127 is generally a toroid of flexible vinyl material, materials and construction of which are well known for inflatable air mattresses. The toroid portion is formed of an outer side wall 134 joined to a top panel 140 and bottom panel 135, which are in turn sealed by inner side wall 144. Floor sections 137 and 145 are joined at section 136 to bottom panel 137 so that they, in combination with inner side wall 144, form the container impression 132 and floor sections 137 and 145 provide vertical structural support for container 101 when flotation device 102 maintains container 101 in a floated state in a body of water. Panels 134, 135, 140 and 144 define an inflated space 146, which is deflated through an access valve when desired. Beverage container walls 143 extend sealingly from top panel 140 at opening 142 down to bottom panel 135 at section 138 to form an impression for receiving and securely holding beverages.

Figure 6:
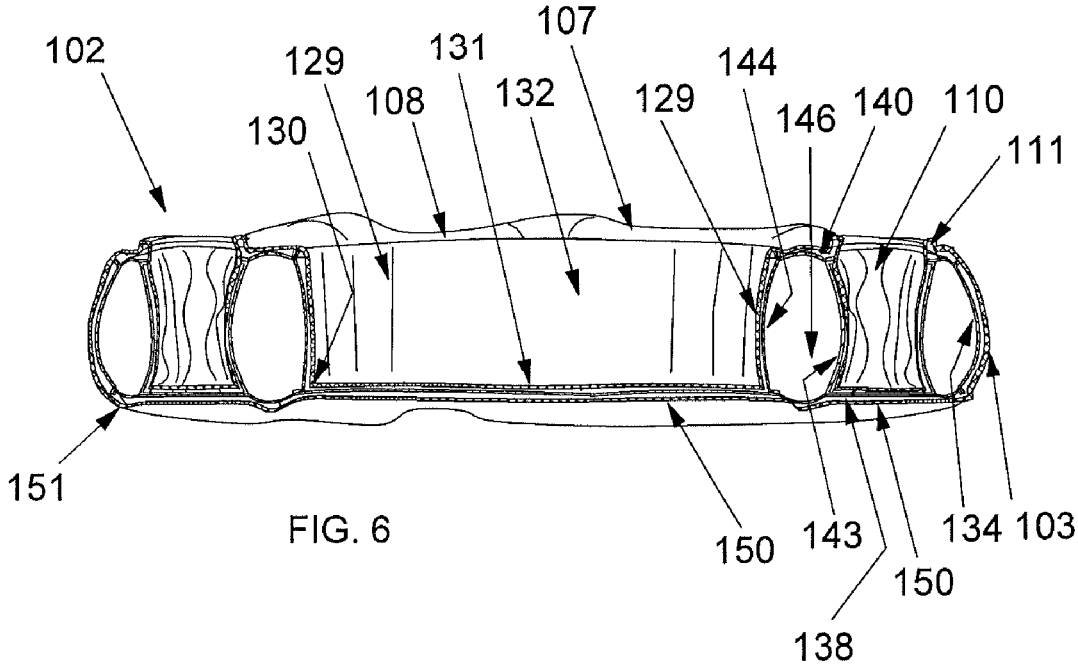
FIG. 6 is a further cross-sectional view taken along line 200-200 of FIG. 3, including an adjacent cross-section of the protective covering of FIG. 2.

FIG. 6 is cross section 200 of FIG. 5 including an enveloping cross section of the protective covering 133 of FIG. 2 of the flotation device 102. Outer side panels 103 and 134 are closely associated, as are inner side panels 129 and 144. Top panels 107 and 140 are closely associated, as are bottom panels 150 and 135, where bottom panel 150 of protective cover 133 also extends in close association with floor section 145. Bottom panel 151 is connected via circular seam 151 to outer side panel 103. It is intended that when flotation bladder 127 is in its inflated state, protective cover 133 will be tightly stretched across the outside surfaces of panels 134, 135, 140 and 144. Note that line beverage container impression 110, which joins top panel 107 at seam 111, is inserted into beverage container walls 143 to protect walls 143.

Figure 7:
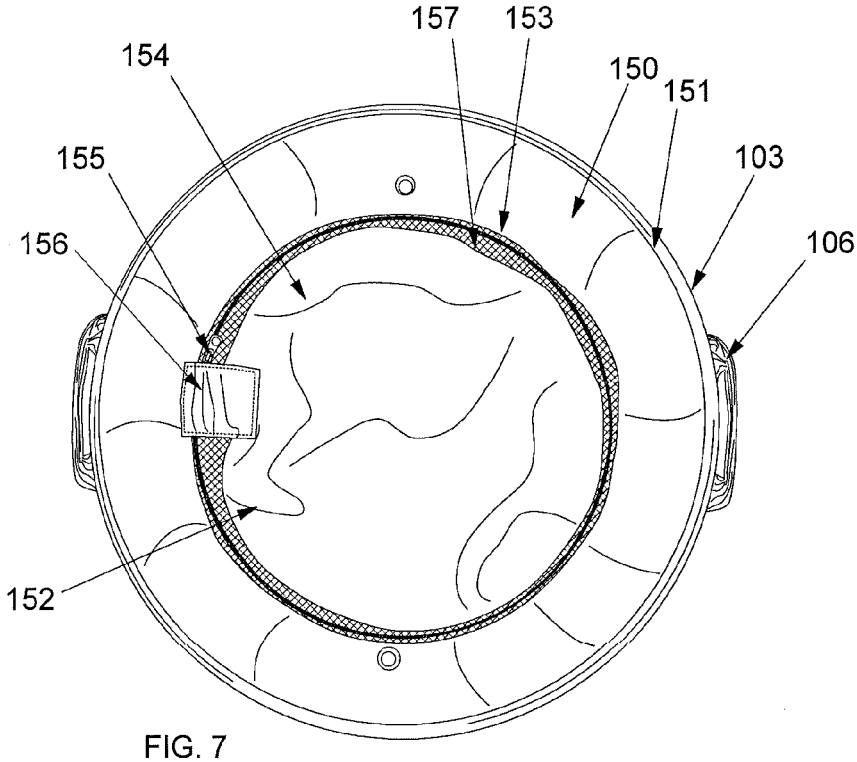
FIG. 7 is a bottom view of the flotation device of FIG. 2, showing a storage flap secured to an underside of the protective covering.

FIG. 7 is a bottom view of the flotation device 102 of FIG. 2 showing bottom panel 150 and a storage flap 152 secured to it. In the exemplary embodiment, zipper side 153 is secured to bottom panel 150, while zipper side 157 is secured to a peripheral edge of flexible panel 154 via a peripherally integral web material 158 (shown in FIG. 8). A hinge panel 156 of flexible material further connects storage flap 152 to bottom panel 150. Slider 155 separates or engages zipper sides 153 and 157. FIG. 7 shows zipper sides 153 and 157 engaged, thereby forming a sealed cavity 176 (FIG. 17) between the variably spaced apart storage flap 152 and bottom panel 150 in which small articles may be stored by opening or closing the zippered edges of storage flap 152. Furthermore, when in use (i.e., when the flotation device 102 is placed on the surface of a body of water), as illustrated in FIG. 17, the storage flap 152 (and cavity 176) functions as a ballast, providing added stability to the invention 100 as well as resistance against being inadvertently pushed by wind and/or currents.

Figure 17:
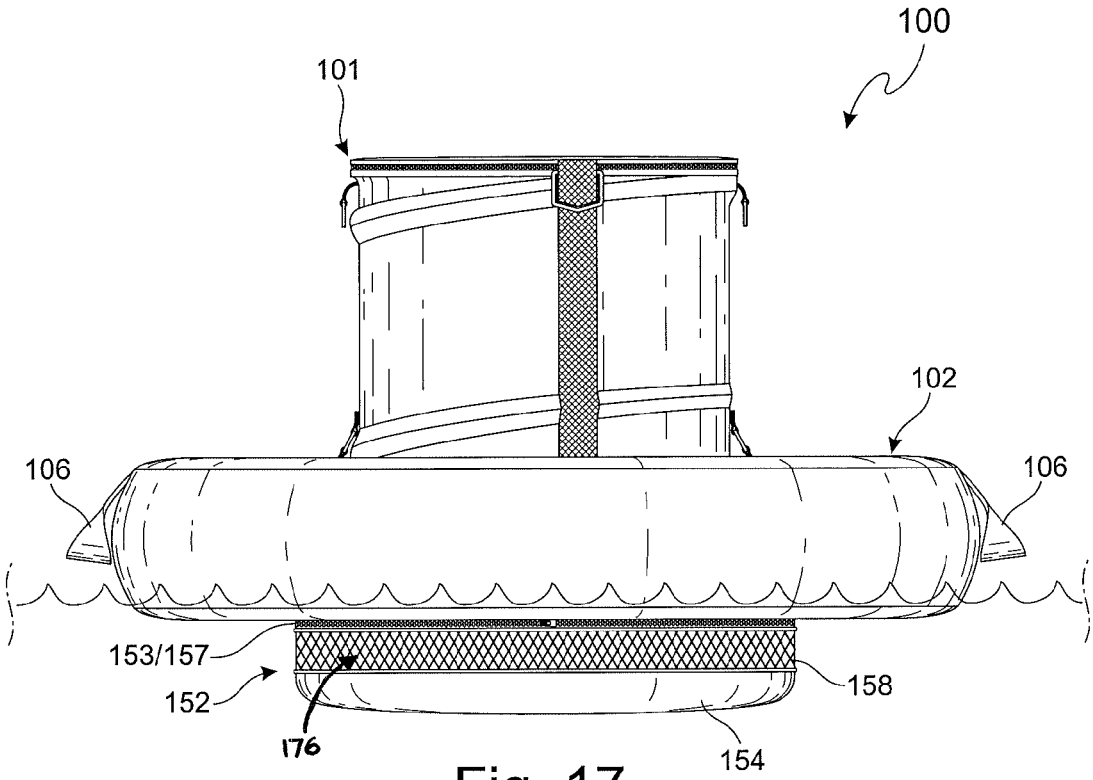
FIG. 17 is a side view of the exemplary embodiment of the present invention during use.

In a bit more detail, and with continued reference to FIG. 17, with storage flap 152 engaged substantially centrally with the bottom panel 150, substantially about an entire free portion of the peripheral edge of the storage flap 152, while the invention 100 is in a body of water, the web material 158 allows water to pass into the cavity 176 created between the variably spaced apart storage flap 152 and bottom panel 150. In the exemplary embodiment, the storage flap is sized and configured such that the cavity 176 therebetween is capable of holding a volume of water sufficient to offset a portion of the combined weight of the invention 100 and any beverages supported by the invention 100. In the exemplary embodiment, the cavity 176 is capable of holding up to roughly twelve pounds of water at any given time (depending on the weight of the invention 100 and the conditions of the body of water), while the invention 100, when filled to capacity with beverages, ice and the like, can weigh up to thirty pounds. Thus, in the exemplary embodiment, the cavity 176 is preferably capable of holding a volume of water sufficient to offset up to at least twenty-five percent of the combined weight of the apparatus and supported beverages. However, in alternate embodiments, this percentage may be more or less. In further embodiments, additional weights, made of materials having a density greater than that of water such as lead, may be removably or permanently positioned within the cavity to assist in offsetting the weight of the invention 100 and beverages. Because the cavity 176 is located substantially below the invention's 100 vertical center of gravity, the added ballast increases stability of the invention 100. Furthermore, when the invention 100 is removed from the body of water, the web material 158 allows the water within the cavity 176 to exit.

Additionally, while the web material 158 allows water to pass into and out of the cavity 176 created between the storage flap 152 and bottom panel 150, the speed at which the water is able to move is restricted (i.e., slowed) by the web material 158. Thus, in the event the flotation device 102 were moved laterally across the surface of the water, depending on the amount of lateral force being used to move the flotation device 102, the web material 158 of the storage flap 152 would function to slow such lateral movement. Thus, where the source of the lateral force is wind and/or water currents, the flotation device 102 would be substantially less likely to move, thereby helping maintain the invention 100 in an area proximal the location it was placed by the user. It should be noted that, in further embodiments, the means for allowing water to pass into and out of the storage flap 152 may be other types of structures and materials, other than web material 158, now known or later developed that would accomplish the same functions. For example, in an alternate embodiment (not shown), the means for allowing water to pass may comprise one or more apertures or grommets integral with the storage flap 152. Additionally, in further embodiments, the placement and configuration of the means for allowing water to pass may differ as well, so long as such placement and configuration accomplishes the same functions. For example, in an alternate embodiment (not shown), the entire storage flap 152 may be made of web material. In yet another embodiment (also not shown), the storage flap 152 may be comprised of a web material having a peripherally integral relatively flexible material. Thus, the configuration of the storage flap 152 should not be limited to only the configuration shown in the drawings.

Figure 8:
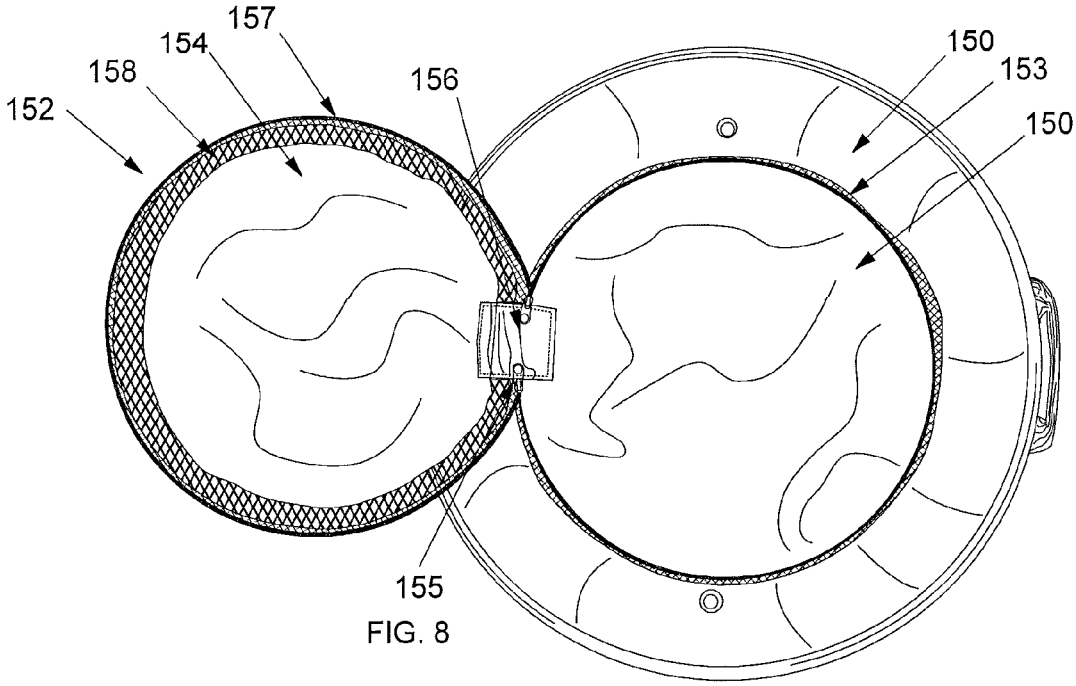
FIG. 8 is a further bottom view thereof, showing the storage flap unzipped from the underside of the protective covering and rotated 180 degrees about a hinge connected to the underside.

In addition to these functions, by virtue of the configuration of storage flap 152, another significant function of storage flap 152 is discussed below. FIG. 8 shows zippered sides 153 and 157 entirely disengaged and storage flap 152 rotated 180 degrees about hinge panel 156, thereby extending it laterally under the inflated portion of the inflation device 102.

Figure 9:
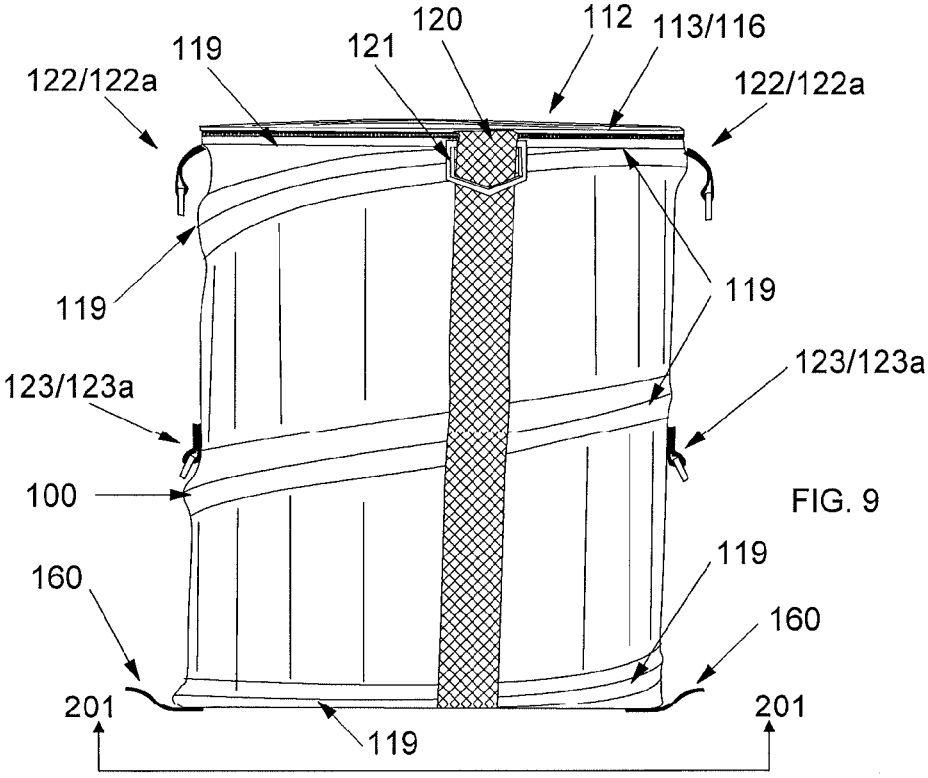
FIG. 9 is a side view of the container of FIG. 2.
Figure 10:
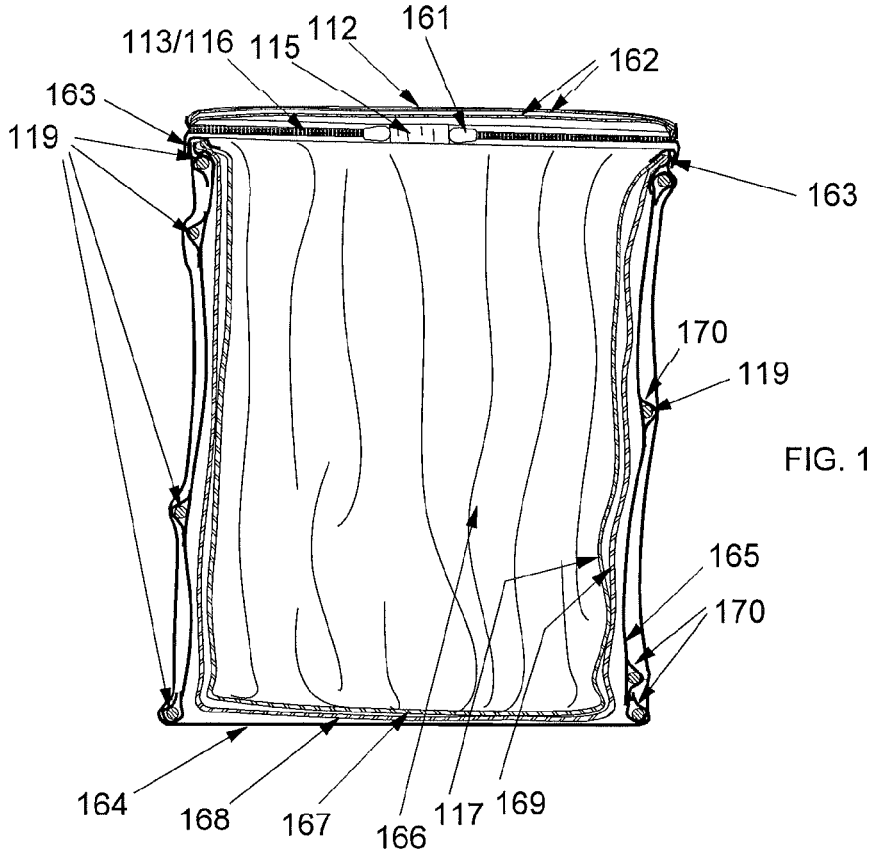
FIG. 10 is a cross-sectional view taken along line 201-201 of FIG. 9.

FIGS. 9 and 10 are respectively side and cross section 201 views of the container 101 of FIG. 2 with a closeable top 112 engaged to seal an opening to the storage space of the container 101. Top 112 is shown with zippered edges 113/116 engaged, thereby enclosing load space 166 defined by cylindrical inner sidewalls 117 and integral floor section 167. Adjacent to inner sidewalls 117 and floor section 167 are cylindrical mid-sidewalls 169 and its integral mid-floor section 168. Sidewalls 117 and 169 and floor sections 167 and 168, including air space between them, comprise insulating layers of flexible materials which insulate load space 166 from the outside environment. In a preferred embodiment, sidewalls 117 and floor section 167 are formed of a polymer sheet with a thickness of about 0.5 to 1.0 thousandths of an inch, where sidewalls 169 and floor section 168 are formed of cloth having a mirrored or reflective surface directed inward to load space 166. In FIG. 9, hook and loop straps 160 are connected to a bottom edge of container 101, each being located directly beneath a combination of loop 122/link 122*a*. FIG. 10, shows that a cylindrical sleeve 165 is located between outer side wall 118 and sidewall 169, whereupon spiral spring 119 is secured via engaging material 170, which is sewn to sleeve 165. The tops of sleeve 165 and sidewalls 118, 169 and 117 are sewn or joined securely together at seam 163.

Figure 11:
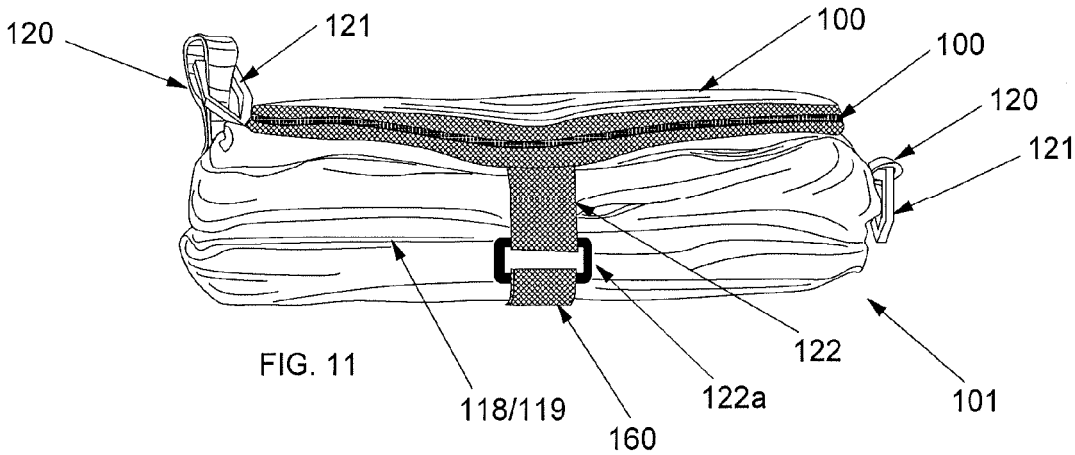
FIG. 11 is a side view of the container of FIG. 9, showing the container in a collapsed, compressed state.

A user may compress container 101 shown in FIGS. 9 and 10. FIG. 11 is a side view of the container of FIGS. 9 and 10 in a collapsed, compressed state. In moving from an open, elevated state in FIGS. 9 and 10 to the compressed state shown in FIG. 11, a user will necessarily fold sleeve 165 and sidewalls 118, 169 and 117 into the compressed state seen in FIG. 11. Hook and loop straps 160 are engaged with links 122*a* so that container 101 remains in its compressed state.

Figure 12:
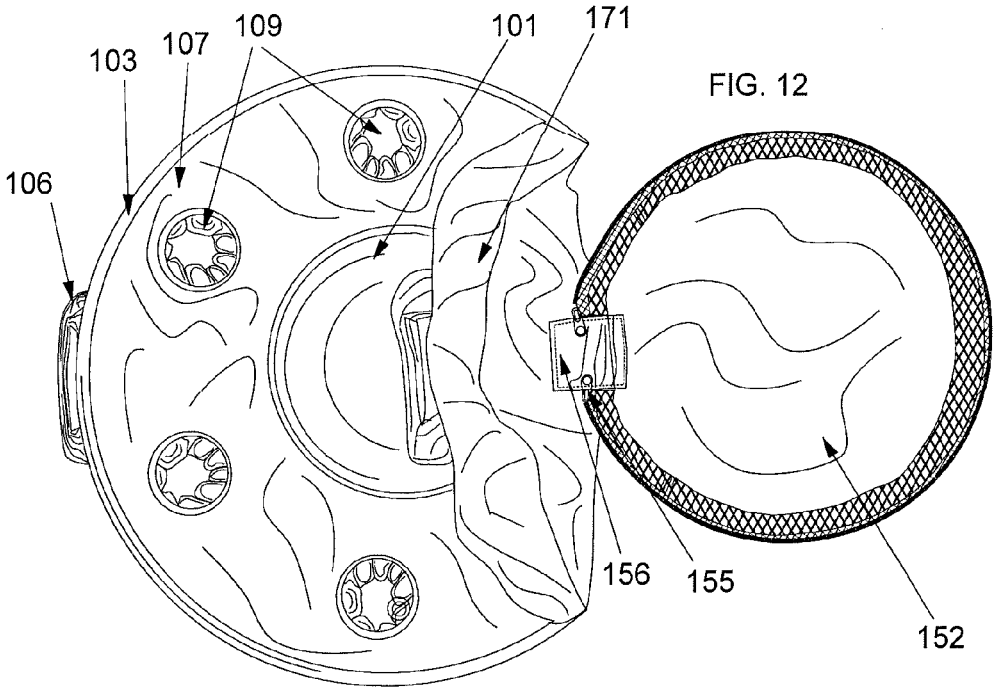
FIG. 12 is a top view of the flotation device of FIG. 8, showing the flotation bladder being deflated and a portion adjacent to the hinge connection folded over the top of the compressed container of FIG. 11 located in the container impression.
Figure 13:
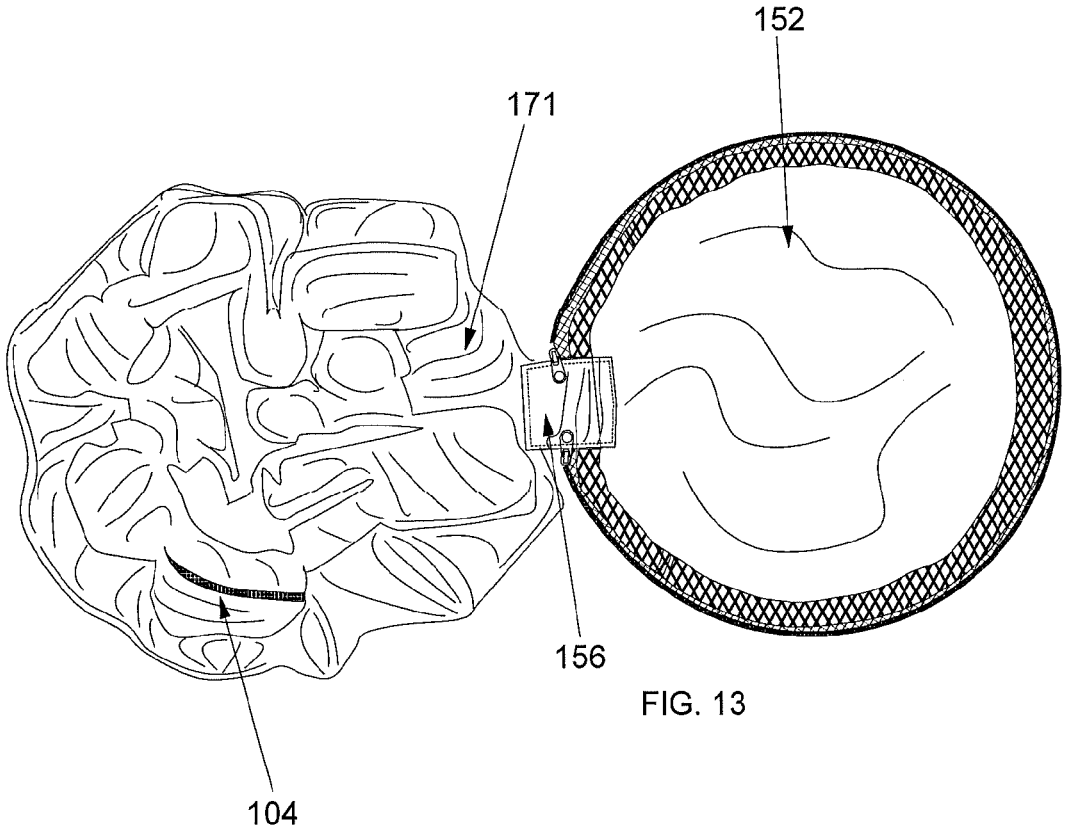
FIG. 13 is a further top view thereof in which all the portions of the flotation device adjacent to the container impression have been folded inward and over the top of the compressed container.

In a further aspect of the flotation device 102, FIG. 12 shows a top view of the flotation device 102 of FIG. 8 with its flotation bladder 127 deflated and a portion 171 of said bladder and its overlying protective layer adjacent to the hinge panel 156 folded over the top of the compressed container 101 of FIG. 11, which has been located in the container impression in the flotation device 101. Storage flap 152 is shown in its position as in FIG. 8 in an extended state. Slider 155 is shown to have user-accessible tabs on both its upper and bottom sides. FIG. 13 shows the assembly of FIG. 12 after a further step wherein all the portions of the flotation device 102 adjacent to the container impression 132 have been folded inward and over the top of the compressed container 101. A user will then rotate storage flap 152 an additional 180 degrees over the folded over parts of flotation device 102, whereafter a user will move slider 155 to engage the sides of the zipper previously disengaged.

Figure 14:
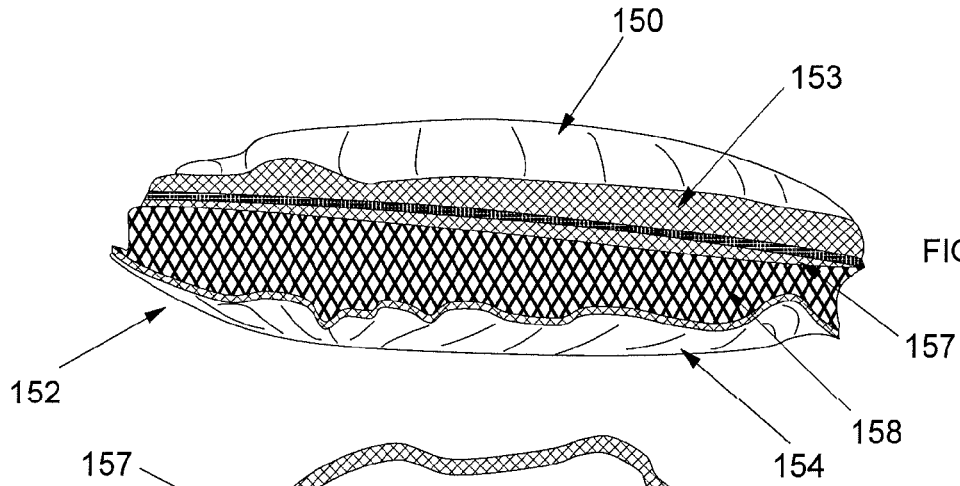
FIG. 14 is a side view of the exemplary embodiment of the present invention, showing the container and flotation device in a compact storage state after the storage flap has been rotated a further 180 degrees over the top of the flotation device and re-zipped.
Figure 15:
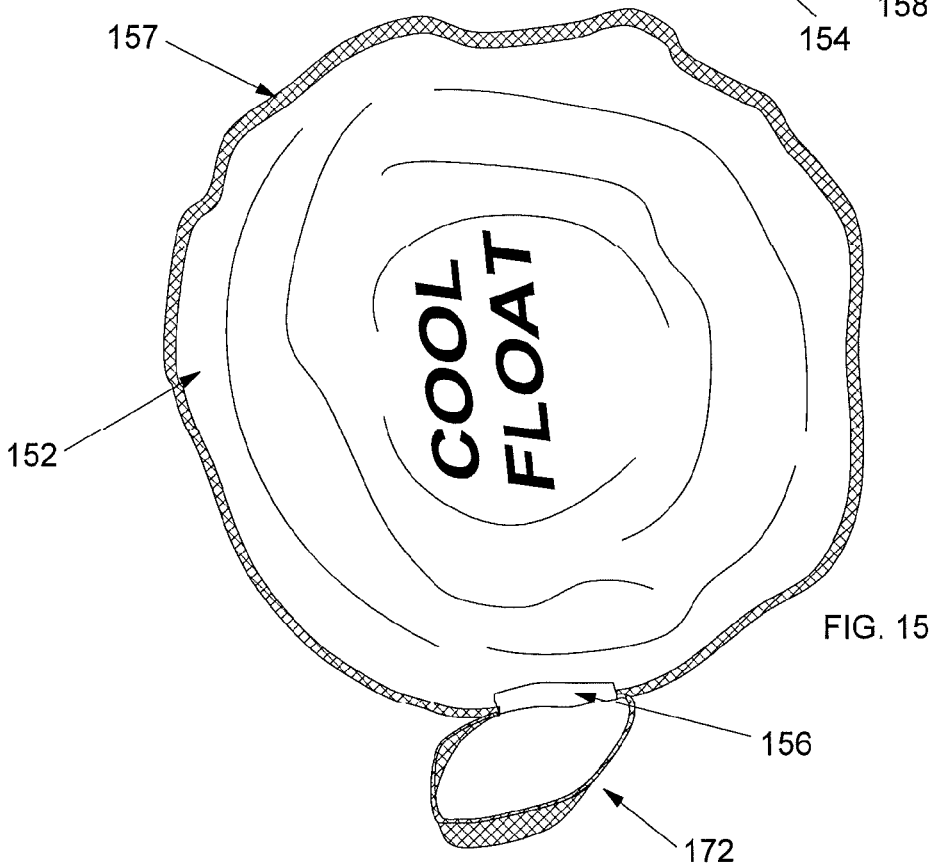
FIG. 15 is a top view thereof.
Figure 16:
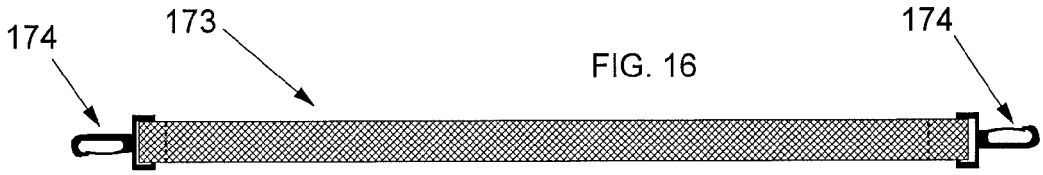
FIG. 16 is a top view of a shoulder strap adapted to be releasably secured to the container of FIG. 9.

FIG. 14 is a side view of the assembly of FIG. 13 after the storage flap 152 has been rotated a further 180 degrees over the top of the flotation device and zipper sides 153 and 157 have been re-zipped to form a storage and carrying enclosure for the flotation device 102 and the container 101. The portion of bottom panel 150 which had previously been enclosed by storage panel 152 in FIG. 7 is exposed in FIG. 14 as a part of the enclosure for the flotation device 102 and container 101. Flotation device 102 may be enclosed and stored as shown in FIG. 14 without also enclosing container 101, i.e., container 101 may be separately stored and used apart from the flotation device 102 in the stored state. FIG. 15 shows a top view of the stored state of flotation device 102 with storage flap 152 bearing the designation "Cool Float". A loop of strap material is optionally connected to hinge panel 156 to form a carrying handle 172.

FIG. 15 top view of a shoulder strap 173 adapted to be releasably secured via clips 174 to links 121 of container 101 as shown in FIG. 9.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A floating beverage cooler apparatus comprising:

a flotation bladder having an inflatable portion;

a protective cover adapted to enclose and cover the flotation bladder, the protective cover providing a bottom panel spanning an underside of the flotation bladder;

a storage flap configured to be at least partially selectively engaged substantially centrally with the bottom panel, substantially about a free portion of a peripheral edge of the storage flap, forming a cavity therebetween, the storage flap having a means for allowing water to pass therethrough; and a securing means integral substantially about the free portion of the peripheral edge of the storage flap and configured for selective engagement with a corresponding securing means integral with the bottom panel;

whereby, the storage flap is capable of selective engagement with the bottom panel in each of a first position, wherein the formed cavity is positioned substantially below the bottom panel when the apparatus is in use, and an opposing second position, wherein substantially all of the deflated flotation bladder and protective cover is positioned within the formed cavity when the apparatus is not in use.

2. The floating beverage cooler apparatus of claim 1, wherein the securing means is a zipper.

3. The floating beverage cooler apparatus of claim 2, wherein the securing means comprises a bottom section zipper side located substantially centrally and symmetrically on the bottom section and a storage flap zipper side located substantially about the free portion of the peripheral edge.

4. The floating beverage cooler apparatus of claim 1, wherein the securing means is hook and loop materials.

5. The floating beverage cooler apparatus of claim 1, wherein a top surface of the flotation bladder comprises one or more impressions adapted to support and retain a beverage.

6. The floating beverage cooler apparatus of claim 1, wherein the storage flap is partially secured to the bottom panel by a hinge.

7. The floating beverage cooler apparatus of claim 1, wherein the storage flap has a diameter relatively smaller than an outer diameter of the flotation bladder.

8. The floating beverage cooler apparatus of claim 1, wherein the means for allowing water to pass therethrough is a web material peripherally integral with the storage flap.

9. The floating beverage cooler apparatus of claim 1, wherein the flotation bladder defines a central container impression, a floor section of the container impression secured to a lowest inner edge of the inflatable portion.

10. The floating beverage cooler apparatus of claim 9, wherein the container impression is adapted to receive and support therein a bottom section of an insulated beverage container having a horizontal cross section shape of the same for the container impression.

11. The floating beverage cooler apparatus of claim 10, wherein the insulated beverage container comprises:

multi-layered sidewalls forming an insulation barrier between an inside and an outside of the container, the sidewalls continuous with an insulated floor section, the sidewalls and floor section defining an insulated load space;

the sidewalls consisting of flexible materials;

one of the sidewalls being effectively continuously connected to spring means extending from a periphery of the floor section upward between an inner and outer sidewall to a top rim of the sidewalls;

an insulated top piece adapted to be connected with and sealing an upper opening defined by the top rim of the sidewalls;

the spring means adapted such that they maintain the container in an elevated position and are capable thereat of retaining a substantial load of ice or beverages in the load space; and the spring means further adapted to be capable of being compressed by a user into a compressed position such that the sidewalls are folded down and retained thereat in a storage state and the compressed position container is adapted to be enveloped with the flotation device.

12. The floating beverage cooler apparatus of claim 11, wherein strap link means are provided at the top rim for attachment of a shoulder strap whereby a user may carry the container.

13. The floating beverage cooler apparatus of claim 11, wherein one of the sidewalls between the inner sidewall and outer sidewall comprises a reflective layer directed toward the load space.

14. The floating beverage cooler apparatus of claim 11, wherein one of the sidewalls between the inner sidewall and outer sidewall comprises a layer of polymer foam or elastomer.

15. The floating beverage cooler apparatus of claim 11, wherein one of the sidewalls between the inner sidewall and outer sidewall maintains an insulating air space between them.

16. A floating beverage cooler apparatus for supporting an at least one beverage, the device comprising:

a flotation bladder having an inflatable portion and providing an at least one container impression configured for removably receiving an insulated beverage container;

a protective cover adapted to enclose and cover the flotation bladder, the protective cover providing a bottom panel spanning an underside of the flotation bladder;

a storage flap partially secured to the bottom panel by a hinge, a remaining free portion of a peripheral edge of the storage flap configured to be selectively engaged substantially centrally with the bottom panel, forming a cavity therebetween, the storage flap having a peripherally integral means for allowing water to pass therethrough; and a securing means integral substantially about the free portion of the peripheral edge of the storage flap and configured for selective engagement with a corresponding securing means integral with the bottom panel;

whereby, the storage flap is capable of selective engagement with the bottom panel in each of a first position, wherein the formed cavity is positioned substantially below the bottom panel when the apparatus is in use, and an opposing second position, wherein substantially all of the deflated flotation bladder and protective cover is positioned within the formed cavity when the apparatus is not in use.

17. A floating beverage cooler apparatus comprising:

a flotation bladder having an inflatable portion;

a protective cover adapted to enclose and cover the flotation bladder, the protective cover providing a bottom panel spanning an underside of the flotation bladder;

a storage flap having a means for allowing water to pass therethrough, the storage flap at least partially selectively engagable substantially centrally with the bottom panel, substantially about a free portion of a peripheral edge of the storage flap; and a securing means integral substantially about the free portion of the peripheral edge of the storage flap and configured for selective engagement with a corresponding securing means integral with the bottom panel;

the storage flap and bottom panel defining a cavity therebetween when the storage flap and bottom panel are selectively engaged with one another, the cavity positioned substantially below the bottom panel and configured for limiting the speed at which water is able to pass therethrough, thereby providing added stability and resistance against lateral forces when the apparatus is positioned on the surface of a body of water.

18. The floating beverage cooler apparatus of claim 17, wherein the cavity is sized and configured for holding a volume of water sufficient to offset up to at least twenty-five percent of the combined weight of the apparatus and supported beverages.

19. The floating beverage cooler apparatus of claim 17, wherein the cavity contains an amount of weighted material having a density greater than that of water to provide further stability and resistance against lateral forces.

* * * * *